US008287165B2

(12) United States Patent
Iwasaki

(10) Patent No.: US 8,287,165 B2
(45) Date of Patent: Oct. 16, 2012

(54) VEHICLE LIGHTING DEVICE

(75) Inventor: Kazunori Iwasaki, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 477 days.

(21) Appl. No.: 12/648,932

(22) Filed: Dec. 29, 2009

(65) Prior Publication Data

US 2010/0177525 A1 Jul. 15, 2010

(30) Foreign Application Priority Data

Jan. 13, 2009 (JP) ..... 2009-004689

(51) Int. Cl.
*F21V 7/09* (2006.01)

(52) U.S. Cl. ..... 362/517; 362/518; 362/519; 362/538; 362/543; 362/298

(58) Field of Classification Search ..... 362/517, 362/516, 518, 519, 507, 508, 514, 538–539, 362/543–545, 241–246, 297, 299–300, 302–303, 362/236, 237, 298; 313/114
See application file for complete search history.

(56) References Cited

FOREIGN PATENT DOCUMENTS

JP 2008-077890 A 4/2008

*Primary Examiner* — Joseph L Williams
(74) *Attorney, Agent, or Firm* — Foley & Lardner LLP

(57) ABSTRACT

A conventional vehicle lighting device entails difficulty in smoothly dimming a part at a downside of a cutoff line of a light distribution pattern. A shade-cum additional reflector includes a cutoff line forming portion which forms an opposite lane side cutoff line, an oblique cutoff line, and a cruising lane side cutoff line, of a light distribution pattern for passing, i.e., a horizontal portion, an inclined portion, and a corner portion, of a protrusion. Of an additional reflecting surface, in proximal to at least the horizontal portion of the protrusion, a spherical convex portion is provided as a diffusion portion for diffusing and reflecting a part of the cut off reflected light onto a side of a projecting lens. As a result, a lighting device of the present invention allows for smooth dimming of a part at a downside of at least the opposite lane side cutoff line, of a light distribution pattern for passing.

14 Claims, 5 Drawing Sheets

VEHICLE LIGHTING DEVICE

CROSS-REFERENCE TO RELATED APPLICATIONS

This application claims priority of Japanese Patent Application No. 2009-004689 filed on Jan. 13, 2009. The contents of this application are incorporated herein by reference in their entirety.

BACKGROUND OF THE INVENTION

1. Field of the Invention

The present invention relates to a vehicle lighting device of a so called projector type, using a semiconductor-type light source, such as an LED, as a light source.

2. Description of the Related Art

A vehicle lighting device of this type is conventionally known (Japanese Laid-open Patent Application No. 2008-77890, for example). Hereinafter, the conventional vehicle lighting device will be described. The conventional vehicle headlamp is made up of: a projecting lens; a light source; a reflector; an additional reflector; and a shading portion. When the light source is lit, the light from the light source is reflected by means of the reflector, and a part of the reflected light is cut off by means of the additional reflector. The remaining one of the reflected light, which has not been cut off, advances to the projecting lens side. The cut off reflected light is further reflected on the projector lens side by means of the additional reflector, and a light distribution pattern having a cutoff line is illuminated from the projecting lens toward a forward direction of a vehicle. The conventional vehicle lighting device is capable of performing smooth dimming as to a part at a downside of the cutoff line of the light distribution pattern by means of the shading portion.

However, the conventional vehicle headlamp allows the shading portion to shade a part of the reflected light from the reflector and a part of the reflected light from the additional reflector, thus removing the light at a part at the downside of the cutoff line of the light distribution pattern. As a result, as to the light distribution pattern, there is a great difference in light intensity between a portion through which the light has passed and its periphery, and it is difficult to smoothly perform dimming.

The present invention has been made in order to solve the above-described problem, i.e., in order to overcome the difficulty in smoothly dimming a part at the downside of the cutoff line of the light distribution pattern in the conventional vehicle lighting device.

SUMMARY OF THE INVENTION

A first aspect of the present invention is directed to a vehicle lighting device, comprising:

(i) a reflector having a convergent reflecting surface based upon an ellipse;

(ii) a semiconductor-type light source, which is disposed so that a light emitting portion is positioned at or near a first focal point of the convergent reflecting surface;

(iii) a projecting lens on which a lens focal point is positioned at or near a second focal point of the convergent reflecting surface; and (iv) a shade-cum additional reflector, which is disposed between the projecting lens and the semiconductor-type light source, and on which a shade, for cutting off a part of reflection light radiated from the semiconductor-type light source and reflected on the convergent reflecting surface, and an additional reflecting surface having the cutoff reflection light reflected on the projecting lens, are provided respectively, wherein:

a cutoff line forming portion, which forms a respective one of an opposite lane side cutoff line, an oblique cutoff line, and a cruising lane side cutoff line, of the light distribution pattern, is provided on the shade-cum additional reflector; and a diffusion portion for diffusing a part of the cut off reflection light is provided in proximity to the cutoff line forming portion which forms at least the opposite lane side cutoff line, of the additional reflecting surface.

A second aspect of the present invention is directed to the vehicle lighting device according to the first aspect, wherein:

the diffusion portion is provided at a site at a side of the cutoff line forming portion which forms the opposite lane side cutoff line from a boundary between the cutoff line forming portion which forms the opposite lane side cutoff line and the cutoff line forming portion which forms the oblique cutoff line, of the additional reflecting surface.

A third aspect of the present invention is directed to the vehicle lighting device according to the first aspect, wherein:

the diffusion portion is formed in a spherical convex shape.

A fourth aspect of the present invention is directed to the vehicle lighting device according to the third aspect, wherein:

a peak of the diffusion portion formed in a spherical convex shape is positioned at a side of the additional reflecting surface with respect to an optical axis of the lighting device.

A fifth aspect of the present invention is directed to a vehicle lighting device, comprising:

(i) a convergent reflector;

(ii) a semiconductor-type light source, which is disposed so that a light emitting portion is positioned at or near a first focal point of the reflector;

(iii) a projecting lens on which a lens focal point is positioned at or near a second focal point of the reflector; and (iv) a shade-cum additional reflector, which is disposed between the projecting lens and the semiconductor-type light source, for cutting off a part of reflection light radiated from the semiconductor-type light source and reflected by means of the reflector to thereby form a cutoff line of a light distribution pattern, and reflecting the cutoff reflection light on the projecting lens, wherein:

the shade-cum additional reflector includes:

a first cutoff line forming portion which forms an opposite lane side cutoff line of the light distribution pattern;

a second cutoff line forming portion which forms an oblique cutoff line; and a third cutoff line forming portion which forms a cruising lane side cutoff line, and wherein:

the first cutoff line forming portion which forms the opposite lane side cutoff line has a diffusion portion for diffusing a part of the cutoff reflection light to a side of the projecting lens so as to perform smooth dimming as to a part at a downside of the opposite lane side cutoff line of the light distribution pattern.

A sixth aspect of the present invention is directed to the vehicle lighting device according to the fifth aspect, wherein:

the diffusion potion is provided in proximity to the first cutoff line forming portion of the shade-cum additional reflector.

A seventh aspect of the present invention is directed to the vehicle lighting device according to the fifth aspect, wherein:

the diffusion portion is provided at a site at a side of the first cutoff line forming portion which forms the opposite lane side cutoff line from a boundary between: the first cutoff line forming portion which forms the opposite lane side cutoff line; and the second cutoff line forming portion which forms the oblique cutoff line.

An eighth aspect of the present invention is directed to the vehicle lighting device according to the fifth aspect, wherein:

the diffusion portion is formed in a spherical convex shape.

A ninth aspect of the present invention is directed to the vehicle lighting device according to the fifth aspect, wherein:

the diffusion portion allows a group of small irregular light diffusion prisms to be formed on a surface of the diffusion portion.

A tenth aspect of the present invention is directed to the vehicle lighting device according to the fifth aspect, wherein:

the diffusion portion is formed in a spherical convex shape; and a peak of the diffusion portion formed in the spherical convex shape is positioned at a reflecting surface side of the shade-cum additional reflector with respect to an optical axis of the lighting device.

An eleventh aspect of the present invention is directed to the vehicle lighting device according to the fifth aspect, wherein:

the diffusion portion allows the peak of the diffusion portion to be positioned downward with respect to the optical axis of the lighting device.

A twelfth aspect of the present invention is directed to the vehicle lighting device according to the fifth aspect, wherein:

the shade-cum additional reflector includes:

a top face plate portion for cutting off the part of the reflection light radiated from the semiconductor-type light source and reflected by means of the reflector to thereby form a cutoff line of a light distribution; and an additional reflecting surface for reflecting the part of the reflected light from the reflector, which is cut off at the top face plate portion, on the projecting lens side;

the additional reflecting surface is comprised of an inclined face with a downward inclination with respect to a horizontal line, toward the projecting lens side and substantially along an optical axis; and the diffusion portion is provided on an additional reflecting surface inclined downward toward the projecting lens side.

A thirteenth aspect of the present invention is directed to the vehicle lighting device according to the fifth aspect, wherein:

the shade-cum additional reflector includes:

a top face plate portion for cutting off the part of the reflection light radiated from the semiconductor-type light source and reflected by means of the reflector to thereby form a cutoff line of a light distribution;

an arc-shaped front face plate portion which is orthogonal to the top face plate portion; and a corner portion which is a corner between the top face plate portion and the front face plate portion, and is positioned at or near the second focal point of the reflector, the corner portion having a protrusion which protrudes upward with respect to a part of the corner, the protrusion at the corner portion of the shade-cum additional reflector is adapted to form:

a horizontal portion as a first cutoff line forming portion which forms the opposite lane side cutoff line; and an inclined portion as a second cutoff line forming portion which forms the oblique cutoff line;

a boundary between the horizontal portion and the inclined portion, of the protrusion, is adapted to form an elbow point which is a crossing portion between the opposite lane side cutoff line and the oblique cutoff line;

the third cutoff line forming portion which forms the cruising lane side cutoff line is formed at a portion other than the protrusion of the corner portion of the shade-cum additional reflector; and the diffusion portion is provided at a side of the horizontal portion from a boundary between the horizontal portion which forms the opposite lane side cutoff line and the inclined portion which forms the oblique cutoff line.

A fourteenth aspect of the present invention is directed to the vehicle lighting device according to the fifth aspect, wherein:

the shade-cum additional reflector is formed in a hollowed shape.

The vehicle lighting device according to the first aspect of the present invention allows a part of reflection light, which is cut off by means of a shade-cum additional reflector, to be diffused (scattered) by means of a diffusion portion provided in proximity to a cutoff line forming portion which forms at least an opposite lane side cutoff line, of an additional reflecting surface, so that at least light of a part at a downside of the opposite lane side cutoff line, of a light distribution pattern, can be weakened. In this manner, the vehicle lighting device according to the first aspect of the present invention becomes capable of performing smooth dimming as to at least the part at the downside of the opposite lane side cutoff line, of the light distribution pattern. In particular, the vehicle lighting device according to the first aspect of the present invention allows the light of the part at the downside of at least the opposite lane side cutoff line, of the light distribution pattern for passing, to be weaken by diffusing (scattering) it without removing it by means of the spherical convex portion as a diffusion portion, so that a difference in light intensity between the part at which light is weakened and its peripheral part can be reduced at the downside of at least the opposite lane side cutoff line of the light distribution pattern for passing, in comparison with the conventional vehicle lighting device in which the light of a part at the downside of a cutoff line of a light distribution pattern is removed by means of a shading portion. As a result, dimming can be performed further smoothly.

In addition, the vehicle lighting device according to the second aspect of the present invention allows a diffusion portion to be provided at a site of the side of the horizontal portion from a boundary between the horizontal portion of the protrusion (cutoff line forming portion forming the opposite lane side cutoff line) and the inclined portion (cutoff line forming portion forming the oblique cutoff line), of the additional reflecting surface, so that smooth dimming can be performed as to a part at the downside of the opposite lane side cutoff line of the light distribution pattern, in a state in which long-distance visibility at the cruising lane side of the light distribution pattern is maintained.

Further, the vehicle lighting device according to the third aspect of the present invention allows a diffusion portion to be formed in a spherical convex shape, so that, even whatsoever the additional reflecting surface may be formed in shape, a part at the downside of at least the opposite lane side cutoff line of the light distribution pattern for passing can be reliably dimmed smoothly. Moreover, the vehicle lighting device according to the third aspect of the present invention allows a diffusion portion to be formed in the shape of a spherical convex, so that: higher manufacturing cost due to an increased number of components is disallowed to occur; and moreover, a part of the reflected light, which is cut off by means of the shade-cum additional reflector, can be reliably diffused and reflected (scattered and reflected) on the side of the projecting lens.

Furthermore, the vehicle lighting device according to the fourth aspect of the present invention allows a peak of the spherical convex portion to be positioned at the side of the additional reflecting face with respect to the optical axis, thus disallowing much of the reflected light to be cut off by means of the shade-cum additional reflector to be diffused (scattered); the light of a portion which is distant from the opposite lane side cutoff line and the oblique cutoff line, of the light distribution pattern for passing, to be weakened, thereby lowering visibility of a front side of the light distribution pattern for passing; or alternatively, disallowing diffused light (scattered light) to increase, thereby causing stray light to make cruising drivers or other opposite lane drivers or pedestrians feel discomfort or something wrong. In other words, if the peak of the spherical convex portion protrudes to a side opposite to the additional reflecting surface with respect to the optical axis, there may be a case in which: much of the reflected light is cut off by means of the shade-cum additional reflector to be diffused (scattered); the light of a portion distant from the opposite lane side cutoff line and the oblique cutoff line, of the light distribution pattern for passing, is weakened, thereby lowering visibility of a front side of the light distribution pattern for passing; or alternatively, a case in which diffused light (scattered light) increases, thereby producing stray light to make cruising drivers or other opposite lane side drivers or pedestrians feel discomfort or something wrong. On the other hand, the vehicle lighting device according to the fifth aspect of the present invention allows the peak of the spherical convex portion to be positioned at the side of the additional reflecting surface with respect to the optical axis, thus making it possible to reliably maintain visibility of the front side of the light distribution pattern for passing, or alternatively, to reliably reduce or prevent an occurrence of stray light which makes cruising drivers, other opposite lane side drivers, or pedestrians feel discomfort or something wrong.

DESCRIPTION OF THE PREFERRED EMBODIMENTS

Figure 1:
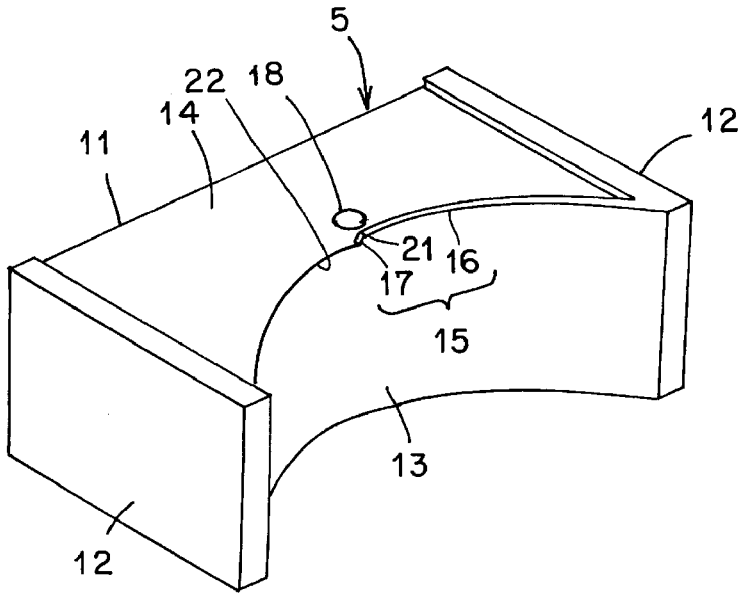
FIG. 1 is a perspective view of a shade-cum additional reflector, showing an embodiment of a vehicle lighting device according to the present invention.

Hereinafter, embodiments of a vehicle lighting device according to the present invention will be described referring to the drawings. These embodiments do not limit the present invention. In the drawings, the uppercase letter "VU-VD" designates an upside-downside vertical line of a screen; the uppercase letter "HL-HR" designates a leftward-rightward horizontal line of the screen; and the uppercase letter "Z-Z" designates an optical axis of the lighting device (any one of the optical axes of the lamp unit, the convergent reflecting surface, and the projecting lens).

Embodiment(s)

Figure 3:
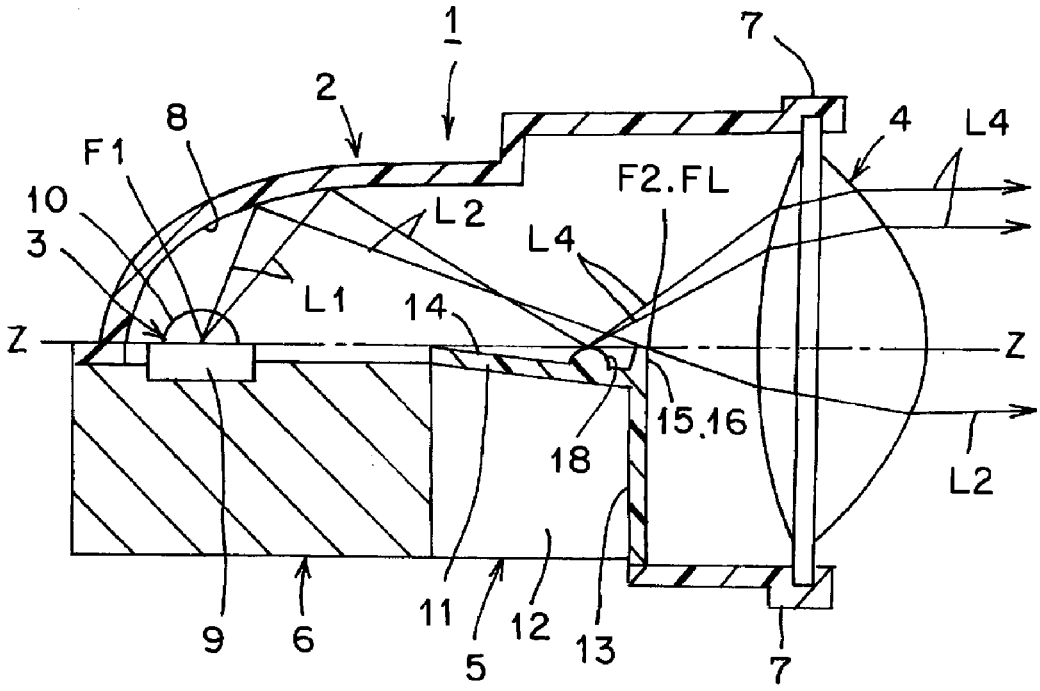
FIG. 3 is a longitudinal cross-sectional view corresponding to a cross section taken along the line III-III of FIG. 2, similarly.

Hereinafter, a constitution of a vehicle lighting device of the embodiment will be described. In the embodiment, a description will be given with respect to a vehicle headlamp, for example. In FIG. 3, reference numeral 1 designates a vehicle lighting device of the embodiment. The vehicle lighting device 1, as shown in FIG. 3, is of a so called projector type, and is formed in a unitary structure. The vehicle lighting device 1 is made up of: a reflector 2; a semiconductor-type light source 3; a projecting lens (convex lens, light focusing lens) 4; a shade-cum additional reflector 5; a heat sink member 6; and a lamp housing and a lamp lens (such as a transparent outer lens, for example) of the vehicle headlamp, although not shown.

The reflector 2, the semiconductor-type light source 3, the projecting lens 4, the shade-cum additional reflector 5, and the heat sink member 6 constitute a lamp unit. The lamp unit is disposed in singularity or plurality, via an optical axis adjustment mechanism, for example, in a lamp room which is partitioned by a lamp housing and a lamp lens, of the vehicle headlamp.

The reflector 2 is made up of a material such as an optically opaque resin member, and also serves as a holding member such as a casing, a housing, or a holder. The reflector 2, the shade-cum additional reflector 5, and the heat sink member 6 are fixed to each other.

A portion of a foreside of the reflector 2 constitutes a cylindrical holder portion 7. The projecting lens 4 is fixed to the holder portion 7. On the other hand, a portion from a center side to a backside of the reflector 2 is made of: a closed part of an upside portion; and an opening of a downside portion, which are substantially horizontally taken along an optical axis Z-Z. A process such as aluminum vapor deposition or silver coating is applied to a concaved interior face of a dome-shaped closed part of the reflector 2, and a convergent reflecting surface 8 is provided.

Figure 4:
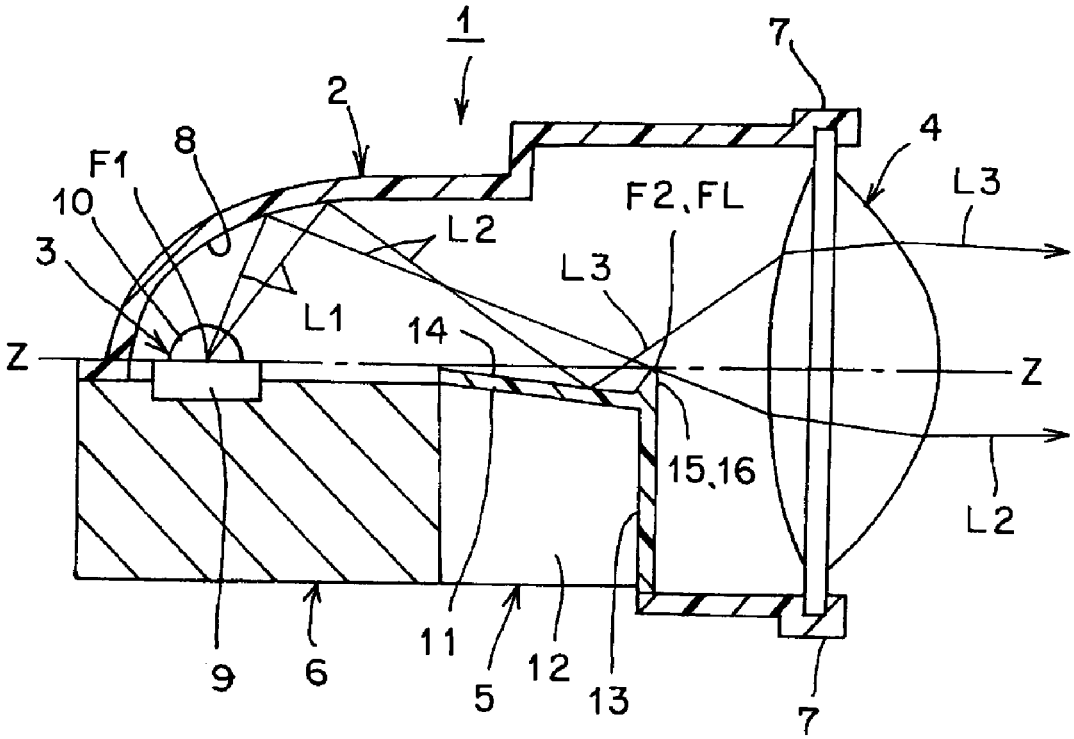
FIG. 4 is a longitudinal cross-sectional view corresponding to a cross section taken along the line IV-IV of FIG. 2, similarly.
Figure 5:
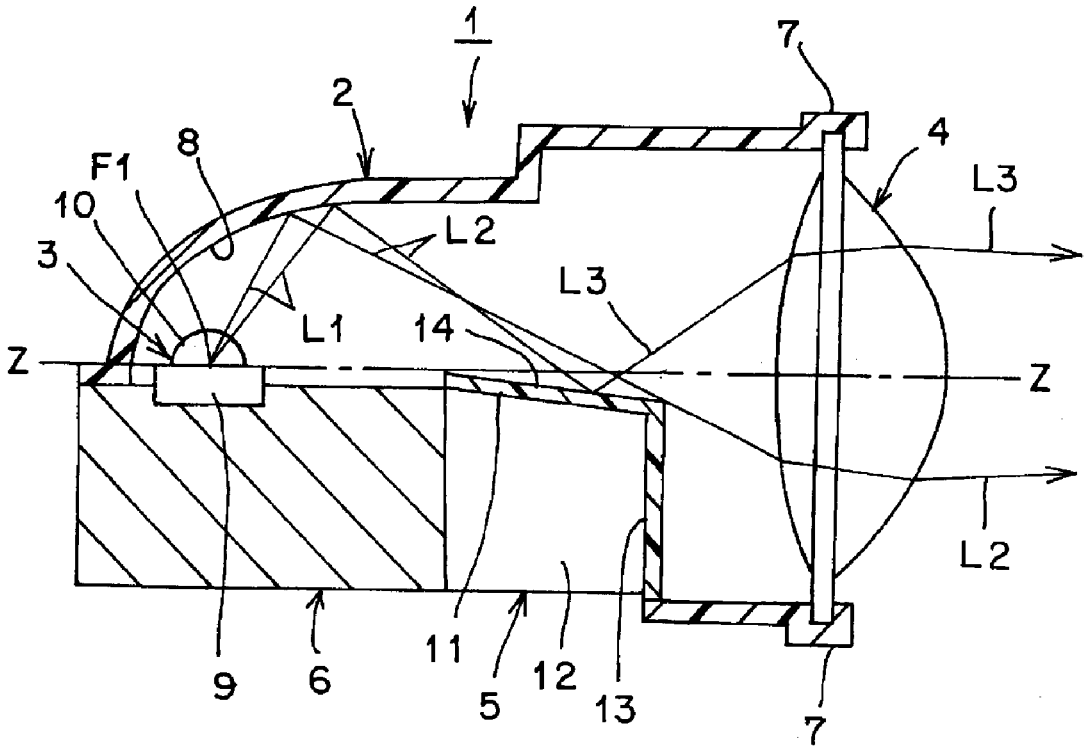
FIG. 5 is a longitudinal cross-sectional view corresponding to a cross section taken along the line V-V of FIG. 2, similarly.

The convergent reflecting surface 8 is made of a reflecting surface based upon an ellipse, for example, a reflecting surface (the reflecting surface on which: an elliptical face is formed in the vertical cross section of FIGS. 3, 4, and 5; and a parabolic face or modified parabolic face is formed in horizontal cross section, although not shown). Thus, the conventional reflecting surface 8 has: a first focal point F1 and a second focal point F2 (a focal line on a horizontal cross section, i.e., a curved focal line of which both ends are positioned at the side of the projecting lens 4, viewed from a top (plane), and of which a center is positioned at the side of the semiconductor-type light source 3); and an optical axis Z-Z.

The semiconductor-type light source 3 uses a self-luminous semiconductor-type light source such as an LED or an EL (organic EL), (an LED in the embodiment). The semiconductor-type light source 3 is made of: a board 9 as a thermally conductive insulation board (for example, ceramics); a light emitting element (not shown) of a very small rectangular (square-shaped) LED chip, provided on one face (top face) of the board 9; and a light transmission member (lens) 10 substantially formed in a hemispheric shape (dome shape), covering the light emitting element. The board 9 of the semiconductor-type light source 3 is fixed to one face (top face) of the heat sink member 6. The light emitting element (light emitting portion) of the semiconductor-type light source 3 is positioned at or near the first focal point F1 of the convergent reflecting surface 8.

The projecting lens 4 is a non-spherical convex lens. A foreside (outside) of the projecting lens 4 is formed of a convex non-spherical face with a large curvature (a small radius of curvature), whereas a backside of the projecting lens 4 (the side of the semiconductor-type light source 3) is formed of a convex non-spherical face with a small curvature (a large radius of curvature). By using an element like the projecting lens 4, a focal point distance of the projecting lens 4 is reduced; and therefore, dimensions in the optical axis Z-Z of the projecting lens 4 of the vehicle lighting device 1 of the embodiment are made compact accordingly. The backside of the projecting lens 4 may be formed of a flat non-spherical face (plane).

The projecting lens 4 has: a foreside focal point (the focal point at the side of the semiconductor-type light source 3) and a backside focal point (external focal point); and an optical axis Z-Z connecting the foreside and backside focal points with each other. The optical axes Z-Z of the convergent reflecting surface 8 and the projecting lens 4 are substantially coincident with each other as optical axes of the lighting device. The foreside focal point of the projecting lens 4 is a lens focal point FL (a meridional image face which is a focal point face at a physical space side). The lens focal point FL of the projecting lens 4 is positioned at or near the second focal point F2 of the convergent reflecting surface 8. Light L1, which is to be radiated from the semiconductor-type light source 3, does not have a high heat, so that a resin-based lens can be used as the projecting lens 4. The projecting lens 4 is acrylic in the embodiment. The projecting lens 4 is intended to illuminate (project) a light distribution pattern having cutoff lines CL1, CL2, CL3, for example, a light distribution pattern for passing (light distribution pattern for low beam) LP to a forward direction of a vehicle.

The shade-cum additional reflector 5 is made of a constituent element such as an optically opaque resin member, like the reflector 2. The shade-cum additional reflector 5 is disposed between the projecting lens 4 and the semiconductor-type light source 3. The shade-cum additional reflector 5, as shown in FIGS. 1 to 5, is formed in a hollowed shape, and is made of: a top face plate portion 11 as a horizontal plate; a transverse face plate portion 12 as a vertical plate; and a front face plate portion 13 as an arc plate. A corner portion (a rim portion or an edge portion) between the top face plate portion 11 and the front face plate portion 13, of the shade-cum additional reflector 5, are positioned at or near the second focal point F2 of the convergent reflecting surface 8, or alternatively, at or near the lens focal point FL of the projecting lens 4.

At the shade-cum additional reflector 5, a shade, i.e., the top face plate portion 11 is provided for cutting off a part L3 of reflection light L2 radiated from the semiconductor-type light source 3 and reflected on the convergent reflecting surface 8 to thereby form the cutoff lines CL1, CL2, CL3 of the light distribution pattern LP for passing.

A process such as aluminum vapor deposition or silver coating is applied to a top face of the top face plate portion 11 of the shade-cum additional reflector 5, and an additional reflecting surface 14 is provided for reflecting the part L3 of the reflected light L2 from the convergent reflecting surface 8, which is cut off by means of the top face plate portion 11 (shade). The additional reflecting surface 14 is formed of an inclined face with a downward inclination and without a step height all over the surface. In other words, the additional reflecting surface 14 is inclined with respect to a horizontal line (about 1 to 3 degrees) while it is substantially taken along the optical axis Z-Z.

At the corner portion between the top face plate portion 11 and the front face plate portion 13 of the shade-cum additional reflector 5, a protrusion 15 is integrally provided at a left-side portion. The protrusion 15 is made of a horizontal portion 16 and an inclined portion 17.

The horizontal portion 16 of the protrusion 15 is a cutoff line forming portion which forms an opposite lane side cutoff line (lower horizontal cutoff line) CL1 of the light distribution pattern LP for passing. The inclined portion 17 of the protrusion 15 is a cutoff line forming portion which forms an oblique cutoff line CL2 of the light distribution pattern LP for passing. A boundary (crossing point) 21 between the horizontal portion 16 and the inclined portion 17, of the protrusion 15, forms an elbow point E which is a crossing point between the opposite lane side cutoff line CL1 and the oblique cutoff line CL2, of the light distribution pattern LP for passing. At the corner portion between the top face plate portion 11 and the front face plate portion 13, of the shade-cum additional reflector 5, a right-side portion 22 is a cutoff line forming portion which forms a cruising lane side cutoff line (upper horizontal cutoff line) CL3 of the light distribution pattern LP for passing.

Figure 2:
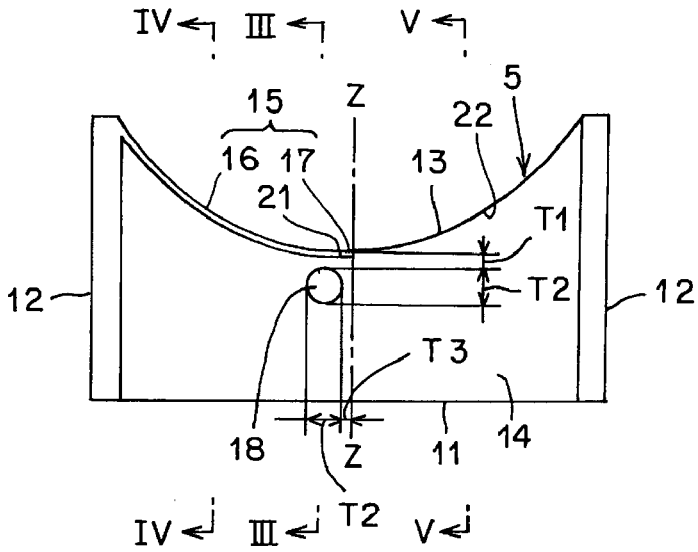
FIG. 2 is a plan view showing the shade-cum additional reflector, similarly.

A spherical convex portion 18 as a diffusion portion is provided in proximity to the protrusion 15 of the additional reflecting surface 14. The spherical convex portion 18 is formed in a hemispherical convex shape. The spherical convex portion 18 is intended to diffuse and reflect (scatter and reflect) a part L4 of the reflected light L3 to be cut off (which is a part of the reflected light L2 from the convergent reflecting surface 8 to be cut off by means of the top face plate portion 11 (shade), the reflected light being reflected on the additional reflecting surface 14). Of the additional reflecting surface 14, the spherical convex portion 18 is provided at the side of the horizontal portion 16 from a boundary 21 between the horizontal portion 16 and the inclined portion 17, of the protrusion 15. As shown in FIG. 2, for example, a diameter T2 of the spherical convex portion 18 is about 1 to 10 mm. In addition, the spherical convex portion 18 is positioned in a location distant by a dimension T1 (about 1 to 3 mm) from the corner portion between the top face plate portion 11 and the front face plate portion 13 to the backside (the side of the semiconductor-type light source 3), of the shade-cum additional reflector 5. Further, the spherical convex portion 18 is positioned in a location which is distant by a dimension T3 (about 0 to 5 mm) from the optical axis Z-Z to the left side.

In addition, as shown in FIG. 3, a peak of the spherical convex portion 18 is positioned downward of the optical axis Z-Z (at the side of the additional reflecting surface 14). On a surface of the spherical convex portion 18, a group of small irregular light diffusion elements (a group of diffusive prisms) is provided, although not shown. The surface of the spherical convex portion 18 is a reflecting surface, since it is an extension of the additional reflecting surface 14. Alternatively, the group of the small irregular light diffusion elements (the group of diffusive prisms) may not be provided on the surface of the spherical convex portion 18.

The heat sink member 6 is made of a material with its high thermal conductivity, such as a resin or a metallic die cast, for example. The heat sink member 6 is shaped like a flat plate at its upper part and is shaped like a fin from its intermediate part to its lower part.

The vehicle lighting device 1 of the embodiment is made of the above-described constituent elements, and hereinafter, functions of these constituent elements will be described.

First, a light emitting element of a semiconductor-type light source 3 of the vehicle lighting device 1 is lit to emit light. Afterward, light L1 is radiated from the light emitting element of the semiconductor-type light source 3. The light L1 is reflected on a convergent reflecting surface 8, and the reflected light L2 converges (concentrates) at a second focal point F2 of the convergent reflecting surface 8. A part L3 of the reflected light L2 that converges (concentrates) at a second focal point F2 is cut off by means of a shade of a top face plate portion 11 of a shade-cum additional reflector 5, and cutoff lines CL1, CL2, CL3, of a light distribution pattern LP for passing, and an elbow point E are formed by a corner portion 22 between: a respective one of a horizontal portion 16, an inclined portion 17, and the top face plate portion 11, of a protrusion 15 of the shade-cum additional reflector 5; and a front face plate portion 13. Most of the reflected light L3, which is cut off by means of the shade-cum additional reflector 5, is reflected on the projecting lens 4 by means of an additional reflecting surface 14 on a top face of the top face plate portion 11 formed of an inclined face with a downward inclination without a step height all over the shade-cum additional reflector 5. On the other hand, the reflected light L2 that has not been cut off by means of the shade of the top face plate portion 11 of the shade-cum additional reflector 5 advances toward the projecting lens 4 as is.

Afterwards, the light L2 having advanced toward the projecting lens 4 and the light L3 having been reflected on the projecting lens 4 pass through the projecting lens 4. These light beams are projected toward a forward direction of an automobile (vehicle), as an image of light obtained by longitudinally and transversely inverting an image of the light at a lens focal point FL of the projecting lens 4, i.e., as a light distribution pattern LP for passing, having cutoff lines CL1, CL2, CL3 and an elbow point E, illuminating a road surface or the like.

Figure 6:
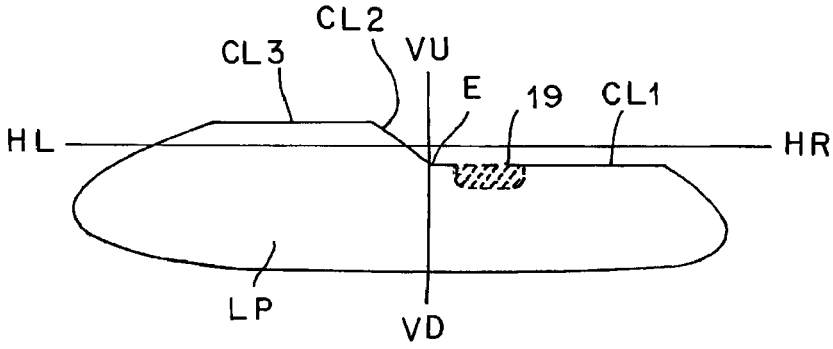
FIG. 6 is an explanatory view of a light distribution pattern for passing, on a screen, showing a light distribution pattern for passing, formed of reflected light from an additional reflecting surface, similarly.
Figure 7:
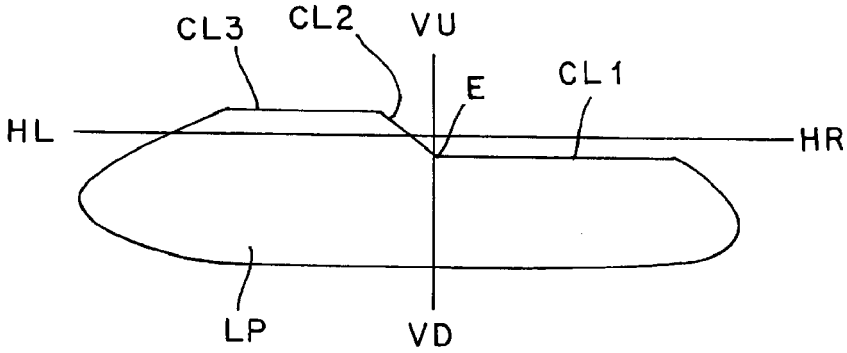
FIG. 7 is an explanatory view of a light distribution pattern for passing, on a screen, showing a light distribution pattern for passing, formed of reflected light from a convergent reflecting surface, the reflected light having not been cut off by the shade-cum additional reflector, similarly.
Figure 8:
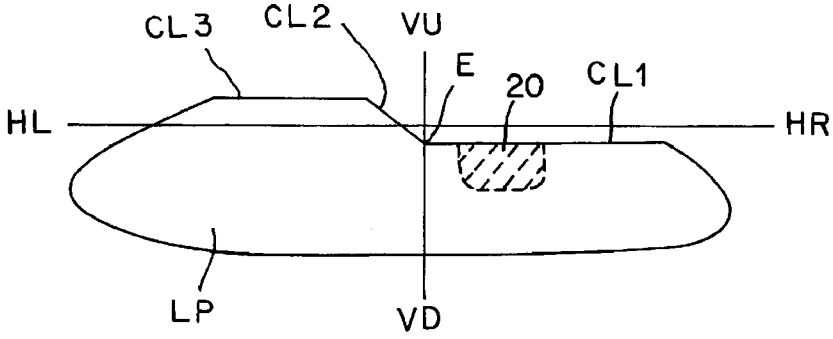
FIG. 8 is an explanatory view of a light distribution pattern, on a screen, showing a light distribution pattern for passing, the pattern being obtained by combining the light distribution patterns for passing, of FIGS. 6 and 7 with each other, similarly.

In addition, as shown in FIG. 3, a part L4 of the reflected light L3 to be cut off by means of the shade-cum additional reflector 5, is diffused and reflected (scattered and reflected) on the projecting lens 4 by means of a spherical convex portion 18 in proximity to a protrusion 15 of the additional reflecting surface 14 (a group of small irregular light diffusion elements (a group of diffusive prisms) on a surface of the spherical protrusion 18). As a result, as shown in FIG. 6, a portion 19 at which light is weak in comparison with a case in which the spherical convex portion 18 is not present (the portion indicated by the oblique dashed line of FIG. 6), is formed at a site corresponding to the side of the opposite lane side cutoff line CL1 from a crossing point elbow point E) between the opposite lane side cutoff line CL1 and the oblique cutoff line CL2, of the light distribution pattern LP for passing, which is formed of most of the reflected light L3 cut off by means of the shade-cum additional reflector 5. On the other hand, as shown in FIG. 7, a light distribution pattern LP for passing, which is formed of the reflected light L2 that has not been cut off by the shade-cum additional reflector 5, is a light distribution pattern for passing, without any portion at which light is weak. By combining these light distribution patterns LP, shown in FIGS. 6 and 7, with each other, a light distribution pattern LP for passing is formed in such a manner that a portion 20 for smooth dimming (the portion indicated by the oblique dashed line of FIG. 8) is formed at a site corresponding to the side of the opposite lane side cutoff line CL1 from a crossing point (elbow point E) between the opposite lane side cutoff line CL1 and the oblique cutoff line CL2, as shown in FIG. 8.

The vehicle lighting device 1 of the embodiment is made of the above-described constituent elements and functions, and hereinafter, advantageous effect(s) thereof will be described.

The vehicle lighting device 1 of the embodiment allows a part L4 of reflected light L3, which is cut off by means of a shade-cum additional reflector 5, to be diffused (scattered) by means of a spherical convex portion 18 as a diffused portion, provided in proximity to a cutoff line forming portion which forms at least an opposite lane side cutoff line CL1 of an additional reflecting surface 14, i.e., a horizontal portion 16 of a protrusion 15, thus making it possible to weaken light of parts 19, 20 at the downside of at least the opposite lane side cutoff line CL1 of a light distribution pattern LP for passing. In this way, the vehicle lightning device 1 of the embodiment allows the light of the part 20 at downside of at least the opposite lane side cutoff line CL1 of the light distribution pattern LP for passing, to be dimmed smoothly. In particular, the vehicle lighting device 1 of the embodiment allows the light of the parts 19, 20 at the downside of at least the opposite lane side cutoff line CL1 of the light distribution pattern LP for passing, to be weaken by diffusing (scattering) them without removing them by means of the spherical convex portion 18 as a diffusion portion, so that a difference in light intensity between: a respective one of the parts 19, 20 at which light is weakened; and its peripheral part, can be reduced at the downside of at least the opposite lane side cutoff line CL1 of the light distribution pattern LP for passing, in comparison with the conventional vehicle lighting device in which the light of a part at the downside of a cutoff line of a light distribution pattern is removed by means of a shading portion. As a result, dimming can be performed further smoothly. In other words, the vehicle lighting device 1 of the embodiment allows the part L4 of the reflected light L3, which is cut off by means of the shade-cum additional reflector 5, to be diffused and reflected on a projecting lens 4 by means of the spherical convex portion 18 as a diffusion portion that is provided in proximity to the protrusion 15 of the additional reflecting surface 14, so that the light at a site corresponding to the side of the opposite lane side cutoff line CL1 from a crossing point (elbow point E) between the opposite lane side cutoff line CL1 and the oblique cutoff line CL2, of the light distribution pattern LP for passing, can be weakened in comparison with a case in which the spherical convex portion 18 as a diffusion portion is not present. In this manner, the vehicle lighting device 1 of the embodiment becomes capable of performing smooth dimming as to a part (portion 20 for smooth dimming) corresponding to the side of the opposite lane side cutoff line CL1 from a crossing point (elbow point E) between the opposite lane side cutoff line CL1 and the oblique cutoff line CL2, of the light distribution pattern LP for passing.

In addition, the vehicle lighting device 1 of the embodiment allows the spherical convex portion 18 as a diffusion portion, to be provided at a site of the side of the horizontal portion 16 from a boundary 21 between the horizontal portion 16 of the protrusion 15 (cutoff line forming portion forming the opposite lane side cutoff line CL2) and the inclined portion 17 (cutoff line forming portion forming the oblique cutoff line CL2), of the additional reflecting surface 14, i.e., provided at a site corresponding to the side of the opposite lane side cutoff line CL1 from a crossing point (elbow point E) between the opposite lane side cutoff line CL1 and the oblique cutoff line CL2, of the light distribution pattern LP for passing, so that smooth dimming can be performed as to a part (portion 20 for smooth dimming) of the light distribution at the downside of the opposite lane side cutoff line CL1 of the opposite lane side, in a state in which long-distance visibility at the cruising lane side is maintained.

Further, the vehicle lighting device 1 of the embodiment allows the spherical convex portion 18 as a diffusion portion, to be formed in a spherical convex shape, so that, even whatsoever the additional reflecting surface 14 may be formed in shape, for example, even if the additional reflecting surface 14 has a different inclination angle or the additional reflecting surface 14 has a step height, there can be reliably dimmed smoothly a part 20 at the downside of at least the opposite lane side cutoff line CL1 of the light distribution pattern LP for passing. Moreover, the vehicle lighting device 1 of the embodiment allows the spherical convex portion 18 as a diffusion portion, to be formed in the shape of a spherical convex, so that: higher manufacturing cost due to an increased number of components is disallowed to occur; and moreover, a part L4 of the reflected light L3, which is cut off by means of the shade-cum additional reflector 5, can be reliably diffused and reflected (scattered and reflected) on the side of the projecting lens 4.

Furthermore, the vehicle lighting device 1 of the embodiment allows a peak of the spherical convex portion 18 to be positioned at the downside (at the side of the additional reflecting face 14) with respect to the optical axis Z-Z, thus disallowing: diffusion (scattering) of much of the reflected light L3 to be cut off by means of the shade-cum additional reflector 5 to thereby weaken the light of a portion which is distant from the opposite lane side cutoff line CL1 and the oblique cutoff line CL2, of the light distribution pattern LP for passing, followed by lowering visibility of a front side (downside of screen) of the light distribution pattern LP for passing, as the result of such weakening; or alternatively, disallowing diffused light (scattered light) to increase, and stray light produced as the result of such increase, to make cruising drivers or other opposite lane side drivers or pedestrians feel discomfort or something wrong. In other words, if the peak of the spherical convex portion 18 protrudes to the upside (opposite side to the additional reflecting surface 14) with respect to the optical axis Z-Z, there may be a case in which: much of the reflected light L3 is cut off by means of the shade-cum additional reflector 5 to be diffused (scattered); the light of a portion which is distant from the opposite lane side cutoff line CL1 and the oblique cutoff line CL2, of the light distribution pattern LP for passing, is weakened, thereby lowering visibility of a front side of the light distribution pattern LP for passing (downside of the screen); or alternatively, a case in which diffused light (scattered light) increases, and stray light produced as the result of such increase makes cruising drivers or other opposite lane side drivers or pedestrians feel discomfort or something wrong. On the other hand, the vehicle lighting device 1 of the embodiment allows the peak of the spherical convex portion 18 to be positioned at the downside (the side of the additional reflecting surface) with respect to the optical axis Z-Z, thus making it possible to reliably maintain visibility of the front side of the light distribution pattern LP for passing (downside of the screen), or alternatively, to reliably reduce or prevent an occurrence of stray light which makes cruising drivers, other opposite lane side drivers, or pedestrians feel discomfort or something wrong.

Still furthermore, the vehicle lighting device 1 of the embodiment allows a group of small irregular light diffusion elements (a group of diffusive prisms) to be provided on a surface of the spherical convex portion 18, thus allowing a part L4 of the reflected light L3, which is cut off by means of the shade-cum additional reflector 5, to be reliably diffused and reflected on the side of the projecting lens 4. As a result, smooth dimming can be performed as to a part (portion 20 for smooth dimming) corresponding to the side of the opposite lane side cutoff line CL1 from a crossing point (elbow point E) between the opposite lane side cutoff line CL1 and the oblique cutoff line CL2, of the light distribution pattern LP for passing.

Yes furthermore, the vehicle lighting device 1 of the embodiment allows the shade-cum additional reflector 5 to be formed in a hollowed shape, so that an occurrence of distortion such as surface sink can be restrained in comparison with a solid-shaped, shade-cum additional reflector. Thus, the vehicle lighting device 1 of the embodiment becomes capable of further reducing an influence of distortion upon the horizontal portion 16 and the inclined portion 17, of the protrusion 15 that is provided on the shade-cum additional reflector 5 formed in the hollowed shape, so that the opposite lane side cutoff line CL1 and the oblique cutoff line CL2, of the light distribution pattern LP for passing, can be further formed with high precision by means of the horizontal portion 16 and the inclined portion 17, of the protrusion 15. Moreover, the vehicle lighting device 1 of this embodiment allows the shade-cum additional reflector 5 to be formed in a hollowed shape, thus making it possible to reduce an influence of distortion upon the corner 22 between the top face plate portion 11 and the front face plate portion 13, of the shade-cum additional reflector 5. As a result, the cruising lane side cutoff line CL3 of the light distribution pattern LP for passing can be formed with high precision, by means of the corner 22 between the top face plate portion 11 and the front face plate portion 13, of the shade-cum additional reflector 5. Moreover, the vehicle lighting device 1 of the embodiment allows the shade-cum additional reflector 5 to be formed in a hollowed shape, thus making it possible to reduce an influence of distortion upon the spherical convex portion 18 as a diffusion portion which is provided on the top face plate portion 11 of the shade-cum additional reflector 5, i.e., the additional reflecting surface 14. As a result, a part 20 of the opposite lane side cutoff line CL1 of the light distribution pattern LP for passing can be dimmed smoothly.

While the vehicle lighting device 1 of the embodiment allows the shade-cum additional reflector 5 to be formed in a hollowed shape, the reflector may be formed in a solid shape. According to the vehicle lighting device of the present invention, even if the shade-cum additional reflector 5 is formed in a solid shape, the opposite lane side cutoff line CL1 and the oblique cutoff line CL2, of the light distribution pattern LP for passing, are formed by means of the horizontal portion 16 and the inclined portion 17, of the protrusion 15 that is provided on the shade-cum additional reflector 5. Thus, even if distortion such as surface sink occurs to the solid-shaped, shade-cum additional reflector, an influence of the distortion upon the solid-shaped, shade-cum additional reflector is reduced at the horizontal portion 16 and the inclined portion 17, of the protrusion 15. Therefore, the vehicle lighting device of the present invention allows the opposite lane side cutoff line CL1 and the oblique cutoff line CL2, of the light distribution pattern LP for passing, to be formed with high precision by means of the horizontal portion 16 and the inclined portion 17, of the protrusion 15 with its small effect of distortion, even if the shade-cum additional reflector is formed in a solid shape and any distortion such as surface sink occurs to the solid-shaped, shade-cum additional reflector.

In addition, the vehicle lighting device 1 of the embodiment is capable of reliably precluding non-uniform light distribution from occurring to the light distribution pattern LP for passing, which is formed of the reflected light L3 from the additional reflecting surface 14, by means of the additional reflecting surface 14 on a top face of the top face plate portion 11 without a step height all over the entire shade-cum additional reflector 5, thus reliably disallowing a dark zone to occur to a portion of a light distribution pattern LP for passing. In this manner, the vehicle lighting device of the embodiment can contribute to traffic safety, since drivers are disallowed to feel visual discomfort due to non-uniform light distribution of a dark zone occurring to a portion of the light distribution pattern LP for passing.

The foregoing embodiment described a vehicle headlamp as a vehicle lighting device for illuminating the light distribution pattern LP for passing, having the cutoff lines CL1, CL2, CL3 and the elbow point E, whereas in the present invention, there may be any light distribution pattern other than that for passing, as long as it has a cutoff line.

The foregoing embodiment described the shade-cum additional reflector 5 formed in a hollowed shape, whereas in the present invention, there may be a solid-shaped, shade-cum additional reflector.

What is claimed is:

1. A vehicle lighting device, comprising:

(i) a reflector having a convergent reflecting surface based upon an ellipse;

(ii) a semiconductor-type light source, which is disposed so that a light emitting portion is positioned at or near a first focal point of the convergent reflecting surface;

(iii) a projecting lens on which a lens focal point is positioned at or near a second focal point of the convergent reflecting surface; and (iv) a shade-cum additional reflector, which is disposed between the projecting lens and the semiconductor-type light source, and on which a shade, for cutting off a part of reflection light radiated from the semiconductor-type light source and reflected on the convergent reflecting surface, and an additional reflecting surface having the cutoff reflection light reflected on the projecting lens, are provided respectively, wherein:

a cutoff line forming portion, which forms a respective one of an opposite lane side cutoff line, an oblique cutoff line, and a cruising lane side cutoff line, of the light distribution pattern, is provided on the shade-cum additional reflector; and a diffusion portion for diffusing a part of the cut off reflection light is provided in proximity to the cutoff line forming portion which forms at least the opposite lane side cutoff line, of the additional reflecting surface.

2. The vehicle lighting device according to claim 1, wherein:

the diffusion portion is provided at a site at a side of the cutoff line forming portion which forms the opposite lane side cutoff line from a boundary between the cutoff line forming portion which forms the opposite lane side cutoff line and the cutoff line forming portion which forms the oblique cutoff line, of the additional reflecting surface.

3. The vehicle lighting device according to claim 1, wherein:

the diffusion portion is formed in a spherical convex shape.

4. The vehicle lighting device according to claim 3, wherein:

a peak of the diffusion portion formed in a spherical convex shape is positioned at a side of the additional reflecting surface with respect to an optical axis of the lighting device.

5. A vehicle lighting device, comprising:

(i) a convergent reflector;

(ii) a semiconductor-type light source, which is disposed so that a light emitting portion is positioned at or near a first focal point of the reflector;

(iii) a projecting lens on which a lens focal point is positioned at or near a second focal point of the reflector; and (iv) a shade-cum additional reflector, which is disposed between the projecting lens and the semiconductor-type light source, for cutting off a part of reflection light radiated from the semiconductor-type light source and reflected by means of the reflector to thereby form a cutoff line of a light distribution pattern, and reflecting the cutoff reflection light on the projecting lens, wherein:

the shade-cum additional reflector includes:

a first cutoff line forming portion which forms an opposite lane side cutoff line of the light distribution pattern;

a second cutoff line forming portion which forms an oblique cutoff line; and a third cutoff line forming portion which forms a cruising lane side cutoff line, and wherein:

the first cutoff line forming portion which forms the opposite lane side cutoff line has a diffusion portion for diffusing a part of the cutoff reflection light to a side of the projecting lens so as to perform smooth dimming as to a part at a downside of the opposite lane side cutoff line of the light distribution pattern.

6. The vehicle lighting device according to claim 5, wherein:

the diffusion potion is provided in proximity to the first cutoff line forming portion of the shade-cum additional reflector.

7. The vehicle lighting device according to claim 5, wherein:

the diffusion portion is provided at a site at a side of the first cutoff line forming portion which forms the opposite lane side cutoff line from a boundary between: the first cutoff line forming portion which forms the opposite lane side cutoff line; and the second cutoff line forming portion which forms the oblique cutoff line.

8. The vehicle lighting device according to claim 5, wherein:

the diffusion portion is formed in a spherical convex shape.

9. The vehicle lighting device according to claim 5, wherein:

the diffusion portion allows a group of small irregular light diffusion prisms to be formed on a surface of the diffusion portion.

10. The vehicle lighting device according to claim 5, wherein:

the diffusion portion is formed in a spherical convex shape; and a peak of the diffusion portion formed in the spherical convex shape is positioned at a reflecting surface side of the shade-cum additional reflector with respect to an optical axis of the lighting device.

11. The vehicle lighting device according to claim 5, wherein:

the diffusion portion allows the peak of the diffusion portion to be positioned downward with respect to the optical axis of the lighting device.

12. The vehicle lighting device according to claim 5, wherein:

the shade-cum additional reflector includes:

a top face plate portion for cutting off the part of the reflection light radiated from the semiconductor-type light source and reflected by means of the reflector to thereby form a cutoff line of a light distribution; and an additional reflecting surface for reflecting the part of the reflected light from the reflector, which is cut off at the top face plate portion, on the projecting lens side;

the additional reflecting surface is comprised of an inclined face with a downward inclination with respect to a horizontal line, toward the projecting lens side and substantially along an optical axis; and the diffusion portion is provided on an additional reflecting surface inclined downward toward the projecting lens side.

13. The vehicle lighting device according to claim 5, wherein:

the shade-cum additional reflector includes:

a top face plate portion for cutting off the part of the reflection light radiated from the semiconductor-type light source and reflected by means of the reflector to thereby form a cutoff line of a light distribution;

an arc-shaped front face plate portion which is orthogonal to the top face plate portion; and a corner portion which is a corner between the top face plate portion and the front face plate portion, and is positioned at or near the second focal point of the reflector, the corner portion having a protrusion which protrudes upward with respect to a part of the corner, the protrusion at the corner portion of the shade-cum additional reflector is adapted to form:

a horizontal portion as a first cutoff line forming portion which forms the opposite lane side cutoff line; and an inclined portion as a second cutoff line forming portion which forms the oblique cutoff line;

a boundary between the horizontal portion and the inclined portion, of the protrusion, is adapted to form an elbow point which is a crossing portion between the opposite lane side cutoff line and the oblique cutoff line;

the third cutoff line forming portion which forms the cruising lane side cutoff line is formed at a portion other than the protrusion of the corner portion of the shade-cum additional reflector; and the diffusion portion is provided at a side of the horizontal portion from a boundary between the horizontal portion which forms the opposite lane side cutoff line and the inclined portion which forms the oblique cutoff line.

14. The vehicle lighting device according to claim 5, wherein:

the shade-cum additional reflector is formed in a hollowed shape.

* * * * *